United States Patent [19]

Sumiyoshi et al.

[11] 4,194,478

[45] Mar. 25, 1980

[54] AIR-FUEL RATIO CONTROL SYSTEM FOR AN INTERNAL COMBUSTION ENGINE

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Toyota Jidosha Kogyo Kabushiki Kaisha, Toyota; Aisan Industry Co., Ltd, Ohbu, both of Japan

[21] Appl. No.: 900,011

[22] Filed: Apr. 25, 1978

[30] Foreign Application Priority Data

Apr. 27, 1977 [JP] Japan ..... 52-48930

[51] Int. Cl.[2] ..... F02M 39/00; F02M 7/00

[52] U.S. Cl. ..... 123/139 AW; 123/139 BG; 123/119 R; 261/50 A

[58] Field of Search ..... 123/139 AW, 139 BC, 123/139 BG, 119 R, 140 MP; 261/50 A

[56] References Cited

U.S. PATENT DOCUMENTS

| | | | |
|---|---|---|---|
| 3,029,800 | 4/1962 | Armstrong | 123/139 AW |
| 3,739,762 | 6/1973 | Jackson | 123/139 AW |
| 3,967,608 | 7/1976 | Mennesson | 123/139 AW |
| 4,031,873 | 6/1977 | Banzhaf et al. | 123/139 AW |
| 4,058,100 | 11/1977 | Tanaka et al. | 123/139 AW |
| 4,085,723 | 4/1978 | Tanaka et al. | 123/139 AW |
| 4,089,308 | 5/1978 | Pierlot | 261/50 A |
| 4,096,838 | 6/1978 | Tanaka et al. | 123/139 AG |

FOREIGN PATENT DOCUMENTS 50-61520 5/1975 Japan .
50-61521 5/1975 Japan .

*Primary Examiner*—Charles J. Myhre
*Assistant Examiner*—P. S. Lall
*Attorney, Agent, or Firm*—Cushman, Darby & Cushman

[57] ABSTRACT

A fuel supply apparatus for an internal combustion engine comprises an air valve disposed in an intake air conduit upstream of a throttle valve and caused to rotate in accordance with the quantity of intake air through the intake conduit, a fuel supply source for supplying fuel under a substantially constant pressure through a fuel feed conduit to a fuel discharge port opened to the intake conduit, and a fuel metering device including a variable slit provided in the fuel feed conduit and interlocked with the air valve to be controlled such that the flow area of the variable slit may be proportional to the quantity of intake air and a fuel differential device for maintaining pressure difference across the variable slit at a predetermined value. The fuel pressure differential device comprises a first pressure chamber applied with a fuel pressure prevailing at the downstream side of the variable slit, a second pressure chamber having a constant pressure difference relative to the first pressure chamber and a constant differential pressure valve disposed in the fuel feed conduit downstream of the variable slit for controlling the pressure at the downstream side of the variable throttle passage to have the aforementioned pressure difference relative to the second pressure chamber. Further the pressure of the second pressure chamber is arranged to be automatically varied dependent on environmental and operating conditions of the engine such as atmospheric pressure, ambient temperature, engine temperature, acceleration and deceleration of the engine, whereby the pressure difference across the variable slit is varied so as to correct the air-fuel ratio.

14 Claims, 6 Drawing Figures

AIR-FUEL RATIO CONTROL SYSTEM FOR AN INTERNAL COMBUSTION ENGINE

BACKGROUND OF THE INVENTION

1. FIELD OF THE INVENTION

The present invention relates in general to a fuel supply apparatus for an internal combustion engine of fuel injection type. In particular, the invention concerns a fuel supply apparatus in which intake air quantity is detected by an air valve disposed within an intake conduit upstream of a throttle valve and adapted to be so controlled that pressure in a constant pressure chamber defined between the air valve and the throttle valve may be maintained constant, while fuel quantity to be supplied to the internal combustion engine is controlled by a fuel metering assembly interlocked with the air valve so as to be proportional to the intake air quantity.

2. DESCRIPTION OF THE PRIOR ART

The fuel supply apparatus of the above type permits a predetermined air-fuel ratio of air-fuel mixture to be established with a relatively high accuracy during normal operation of internal combustion engines, whereby purification of exhaust gas from the engine can be accomplished to a reasonable degree. However, in order to attain an adequate and satisfactory purification of the exhaust gas under all various operating conditions of the engine, it is necessary to perform correction on the air-fuel ratio in consideration of the instantaneous operating conditions such as temperature of ambient air, atmospheric pressure, temperature of the engine, acceleration and deceleration of the engine and the like.

From Japanese Laid-Open Patent Application No. 38220/73, a fuel supply apparatus of the aforementioned type has been already known in which the ratio of the metered fuel quantity relative to the intake air quantity is caused to vary by correspondingly varying a fuel pressure difference produced across the fuel metering device in dependence on a certain specified operating condition of the engine, thereby to permit the air-fuel ratio to be corrected to obtain the optimum ratio. However, this known apparatus is disadvantageous in that the structure is complicated, the air-fuel ratio is corrected merely in response to change of only one factor representing an operating condition of the engine, and a fine control of the air-fuel ratio can not be accomplished in a satisfactory manner due to the fact that the apparatus is operated on the basis of proportional control principle and thus exhibit poor follow-up performance in response to abrupt changes in the intake air quantity.

SUMMARY OF THE INVENTION

A primary object of the present invention is to provide a fuel supply apparatus for an internal combustion engine of the aforementioned type which allows the air-fuel ratio to be corrected in response to changes or variations in numerous factors representing various operating conditions or states of the internal combustion engine with a view to attaining an optimum operation with a simplified structure.

Another object of the invention is to provide a fuel supply apparatus of the above described type which includes an air-fuel ratio controlling system operative based on the integration control principle and capable of following up transient conditions with an acceptable response delay.

In view of the above and other objects which will become more apparent as the description proceeds, there is proposed according to one aspect of the invention a fuel supply apparatus for an internal combustion engine which comprises a throttle valve disposed in an intake conduit, an air valve disposed in the intake conduit upstream of the throttle valve, means for controlling the air valve in response to pressure prevailing within an air pressure chamber defined between the air valve and the throttle valve so that the pressure may be maintained at a substantially constant level, a fuel supply source for supplying fuel through a fuel feed conduit under a substantially constant pressure, and a fuel metering means including a variable slit provided in the fuel feed conduit and interlocked with the air valve to be controlled so that the flow section area of the slit may be proportional to the opening area of the air valve and a fuel pressure differential device for maintaining the difference in pressure produced across the variable slit at a predetermined valve, wherein the fuel pressure differential device comprises a first pressure chamber applied with a fuel pressure prevailing at the downstream side of the variable slit, a second pressure chamber having a constant pressure difference relative to the first pressure chamber and a constant differential pressure valve disposed in the fuel feed conduit downstream of the variable throttle passage so as to respond to variation in the pressure difference between the first and the second pressure chambers thereby to control the pressure prevailing at the downstream side of the variable slit in order to maintain the pressure difference constant, and means for automatically varying the pressure in the second pressure chamber in dependence on environmental and/or operating conditions of the internal combustion engine. with such arrangement, variation in the pressure chamber within the second pressure involves corresponding variation in the pressure within the first pressure chamber to vary the previously set pressure at the downstream side of the variable throttle passage. Consequently, the pressure difference produced across the variable slit is varied thereby to change the flow rate of fuel passing through the variable slit and hence eventually vary the air-fuel ratio.

According to a preferred embodiment of the invention, the fuel supply apparatus includes a high pressure source and a low pressure source, each being maintained at a predetermined level relative to a reference pressure. The second pressure chamber is disposed in a circuit connecting the first and second fuel pressure sources to each other. In the circuits upstream and downstream of the second pressure chamber, there are disposed a switchable valve, a variable throttle, a variable volume chamber and the like which are caused to respond to several factors representing various operating conditions of the engine, respectively, thereby to control the flow resistance and the flow rate of fuel in the above circuits in order to regulate the pressure within the second pressure chamber and hence the air-fuel ratio.

It is preferred that the high pressure source and the low pressure source are constituted by a high pressure fuel supply source and a low pressure fuel supply source, respectively. With this arrangement, the response performance of the control apparatus can be significantly enhanced.

The above and other objects, novel features and advantages of the invention will become more apparent from the description of exemplary embodiments of the invention taken in conjunction with the accompanying drawings.

DETAILED DESCRIPTION OF THE PREFERRED EMBODIMENTS

Figure 1:
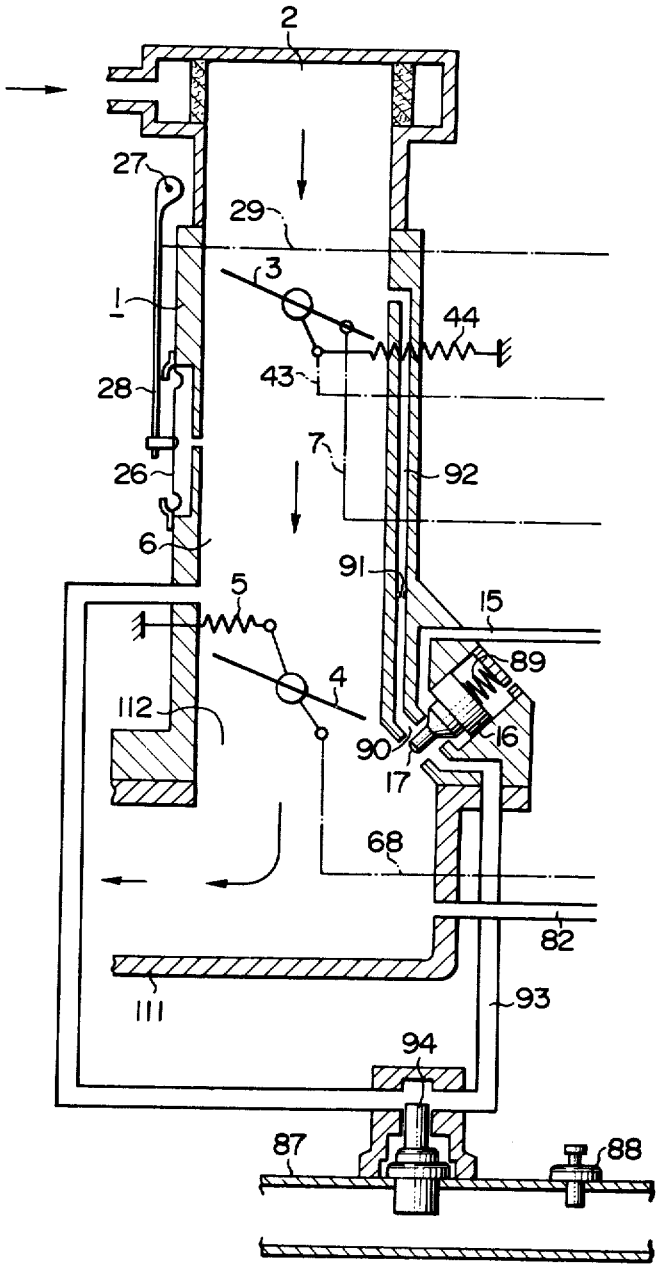
FIG. 1 is a sectional view showing schematically an air intake conduit portion of an internal combustion engine to be combined with a fuel supply apparatus according to the invention.

Referring to FIG. 1 which shows in a sectional view an intake conduit portion of an internal combustion engine provided with a fuel supply apparatus according to an embodiment of the invention, reference numeral 1 denotes a main body of the apparatus which includes an air cleaner 2 mounted at the top inlet port thereof as well as an air valve 3 and a throttle valve 4 disposed therein. Air as sucked through the air cleaner 2 passes through the air valve 3 and the throttle valve 4 to an intake conduit 111 and hence is fed to the engine cylinders through intake ports (not shown). The throttle valve 4 is usually biased toward the closing position under the action of a spring 5 and adapted to control intake air flow through angular displacement thereof as caused by corresponding actuation of an acceleration pedal (not shown), as is well known in the art. On the other hand, the direction in which the air valve 3 is rotated depends on the quantity of intake air, i.e. the air valve 3 is rotated in the opening direction as the intake air flow is increased, while the valve 3 is rotated in the closing direction as the intake air flow is decreased. The angular position taken by the air valve is controlled by a feedback control apparatus described hereinafter in such a manner that the depression in an air pressure chamber 6 defined between the air valve 3 and the throttle valve 4 within the mainbody 1 will remain constant. The air valve 3 is coupled to a fuel metering rod 8 shown in FIG. 2 through a linkage represented by a dotted broken line 7. The fuel metering rod 8 is slidably disposed within a cylinder 9 and adapted to be axially displaced as the air valve 3 is rotated. In this connection, it is to be noted that the connection between the air valve 3 and the fuel metering rod 8 through the coupling linkage 7 is made such that the displacement of the fuel metering rod 8 is proportional to changes in opening degree of the air valve 3, i.e. change in area of gap defined between the outer periphery of the air valve 3 and the cylindrical inner wall of the main body 1. As can be seen from FIG. 2, the fuel metering rod 8 has an inner end portion 10 located within the cylinder 9 formed with a counter-bore or hollow portion around the axis thereof. A pair of slits 10A are formed axially in the peripheral wall of the hollow end portion 10 so as to split the latter into two semi-cylindrical halves. A passage 11 which is communicated with a fuel supply source (a high pressure fuel source 20 described hereinafter) is opened into the cylinder 9 at the closed end thereof. Further, the cylinder 9 is formed with an annular groove 12 in the inner wall into which a passage 13 is opened. With such arrangement, the fuel flowing into the cylinder 9 through the passage 11 will flow through the slits 10A into the annular groove 12 and hence into the passage 13. The slits 10A and the annular groove 12 thus constitute a variable slit having a variable flow section which can be variably set in dependence upon the degree of superposition between the slits 10A and the annular groove 12. In this conjunction, it should be recalled that the fuel metering rod 8 is interlocked with the air valve 3 so that the position of the rod 8 may proportionally depend on the opening degree of the air valve 3. Consequently, the flow section of the variable slit formed by the slits 10A and the annular groove 12 will vary in proportion to variation in the opening degree of the air valve 3. The fuel thus metered through the metering rod assembly 8 flows through the passage 13 to a fuel pressure differential apparatus 14 and hence to a fuel injection valve 16 (FIG. 1) through a passage 15. Upon opening of the injection valve 16 under the pressure of fuel, the latter is injected into the interior space 112 of the intake conduit through a fuel nozzle 17 located downstream of the throttle valve 4. It should be mentioned that the fuel pressure differential apparatus 14 serves to maintain a constant difference in pressure between the upstream and the downstream sides of the variable slit of the fuel metering rod 8, as will be described in detail hereinafter.

Figure 2:
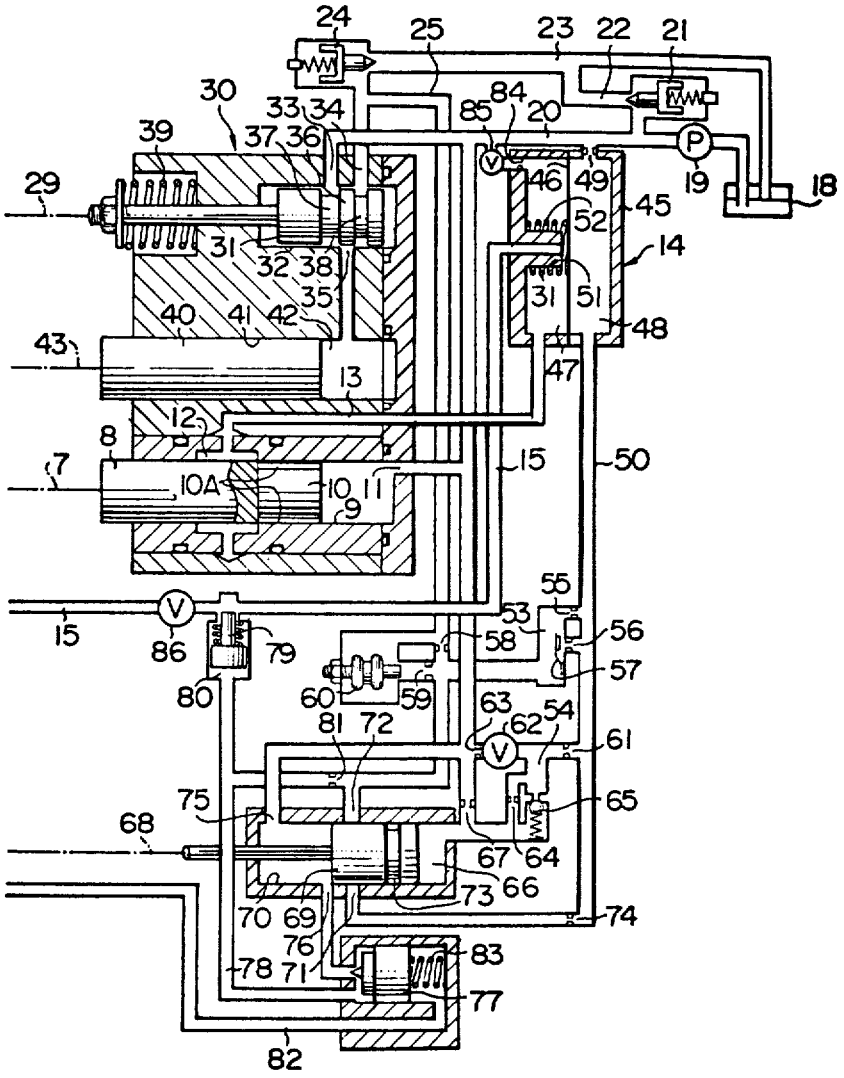
FIG. 2 is a sectional view showing schematically the general arrangement of a fuel supply apparatus according to an embodiment of the invention.

In FIG. 2, the fuel contained in a fuel tank 18 is fed under pressure by means of a fuel pump 19, whereby a portion of the pumped fuel is injected into the interior 112 of the intake conduit 111 from the fuel injection nozzle 17 after having been metered by the fuel metering rod 8. A conduit 20 connected to the discharge side of the fuel pump 19 is communicated with a fuel return passage or conduit 23 through a by-pass conduit 22 provided with a high pressure valve 21, thereby constituting a high pressure fuel source maintained at a high pressure with a constant apparatus difference relative to the atmospheric pressure. A low pressure valve 24 is installed in the return conduit 23 upstream of the junction between the return conduit 23 and the by-pass conduit 22, whereby a low pressure fuel source 25 is constituted upstream of the low pressure valve 24 which maintains a constant pressure difference smaller than that of the high pressure fuel source 20 relative to the atmospheric pressure.

As described hereinbefore, the pressure prevailing in the pressure chamber 6 defined between the air valve 3 and the throttle valve 4 is maintained constant independently of the intake air flow or quantity with the aid of the feedback control system. In a typical embodiment of the feedback control system described below, the fuel from the high pressure fuel source 20 as well as the low pressure fuel source 25 is advantageously utilized for the operation of the control system.

Formed in the outer wall of the main body 1 at the location where the air pressure chamber 6 is formed in the interior thereof is a recess which is communicated to the air pressure chamber 6 and covered by a diaphragm 26. An arm 28 pivotally mounted at 27 is attached at its free end to the diaphragm 26 so that variation in pressure within the air pressure chamber 6 may give rise to a pivotal movement of the arm 28 through the diaphragm 26. Thus, the diaphragm functions as a pressure sensor for detecting pressure prevailing in the air pressure chamber 6. The movement of the arm 28 is transmitted to a spool 31 of a pilot valve 30 shown in FIG. 2 through a connecting link represented by a dotted broken line 29. Two ports 33 and 34 are opened in a bore 32 accommodating slidably the spool 31, which ports 33 and 34 are communicated to the high pressure fuel source 20 and the low pressure fuel source 25, respectively. At the side opposite to the ports 33 and 34, there is formed a port 35 in the bore 32 which is located at a middle portion between the ports 33 and 34, as viewed in the axial direction of the bore 32. The spool 31 is further formed with two annular grooves 37 and 38 which are partitioned by a land 36 having a width substantially equal to the diameter of the port 35 and communicated to the ports 33 and 34, respectively. The spool 31 is maintained in a balanced position under the influence of a spring 39 and the force exerted by the arm 28 of the pressure sensor 26 so that the fuel flow from the port 33 into the port 35 is balanced with the fuel flow from the port 35 into the port 34 when the pressure within the air pressure chamber 6 is at a preset level. The port 35 is communicated with a chamber 42 defined in a cylinder 41 by an air valve drive piston 40 accommodated therein. The air valve drive piston 40 is connected to the air valve 3 through a link represented by a dotted broken line 43. The air valve 3 is usually urged toward the closing position under the action of a tension spring 44.

Assuming that the opening degree of the throttle valve 4 is increased with the intake air flow being correspondingly increased during the operation of the engine, the pressure in the air pressure chamber 6 will become lower than a preset level so long as the opening degree of the air valve 3 remains unvaried. Such reduction in pressure will be detected by the pressure sensor diaphragm 26 and result in movement of the spool 31 through the arm 28 to the right as viewed in the drawing, which in turn involves a correspondingly increased flow section of the fuel constriction passage constituted by the port 35 and the annular groove 37, while the flow section of the constriction passage constituted by the port 35 and the annular groove 38 is simultaneously decreased. Under such conditions, the fuel from the high pressure source 20 will flow into the chamber 42 of the bore 41 through the port 33, annular groove 37 and the port 35, as a result of which the piston 40 is moved to the left as viewed in the drawing, thereby to rotate the air valve 3 in the opening direction against the force of the spring 44. Consequently, resistance to the air flow through the air valve 3 is decreased. This means that the pressure within the air pressure chamber 6 will be raised toward the preset level. Such pressure increases will cause the spool 31 to be moved leftwards through the diaphragm 26 and the arm 28, whereby the spool 31 is returned to the neutral position at which the land 36 is aligned with the port 35, when the pressure in the chamber 6 has attained the preset level. At that time, the fuel quantity flowing into the chamber 42 from the high pressure source 20 becomes equal to the fuel flow leaving the chamber 42 to the low pressure source 25, thereby to stop the piston 40. The air valve 3 is thus set at a new opening degree. On the contrary, when the pressure in the chamber 6 is increased beyond the preset level by decreasing the opening of the throttle valve 4, the spool 31 is displaced from the neutral position to the left, resulting in a decreased fuel flow into the port 35 from the annular groove 37, while the fuel flow from the port 35 into the annular groove 38 is increased. Consequently, the pressure prevailing in the chamber 42 is lowered with the piston 40 being moved rightwards under the action of the spring 44 to rotate the air valve 3 in the closing direction. When the pressure within the air pressure chamber 6 is lowered to the preset valve, the spool 31 will then be restored to the neutral position with the air valve 3 being set at a reduced opening.

As will be appreciated from the foregoing description, the pressure sensor diaphragm 26, the pilot valve 30 and the air valve driving piston 40 constitutes a feedback control circuit which functions to rotate the air valve 3 in the opening direction in response to decrease in the pressure within the air pressure chamber 6, while rotating the valve 3 in the closing direction in response to increase in pressure within the chamber 6, thereby to adjust the opening degree of the air valve so that the pressure within the chamber 6 may be constantly maintained at a preset constant level independently of the intake air quantity. Since the performance of the feedback control circuit is of integration nature, no instability will occur even for abrupt or rapid change in the intake air quantity. Further, delay in response can be relatively reduced because of use of the high pressure fuel as the operating medium. The pressure level set at the air pressure chamber 6 is determined by the balance between the force exerted to the diaphragm 26 and the forces of springs 39 and 44.

Next, description will be made on the fuel pressure differential apparatus 14 for maintaining the pressure difference of fuel constant between the upstream and the downstream sides of the slit having a variable flow section as constituted by the fuel metering rod 8. The fuel pressure differential apparatus 14 includes a housing 45 in which first and second chambers 47 and 48 are formed as partitioned from each other through a diaphragm 46 mounted in the housing 45 in a tensioned state. The second pressure chamber 48 is communicated with a high pressure fuel source 20 through a fixed throttle 49 and at the same time communicated through a conduit 50 and various fixed and variable orifice elements described hereinafter to the high pressure fuel source 20 and the low pressure fuel source 25. Accordingly, the pressure within the second pressure chamber 48 is maintained at a constant intermediate level between the pressure levels in the high and low pressure fuel sources, so far as the variable elements remain in the unvarying state. The passage 13 extending from the annular groove 12 formed in the cylinder 9 accommodating slidably the fuel metering rod 8 is opened into the first pressure chamber 47 which is thus subjected to the pressure prevailing at the downstream side of the variable slit constituted by the fuel metering rod 8. Furthermore, in the first pressure chamber 47, there is disposed adjacent and in opposition to the diaphragm 46 a valve seat 51 in which the fuel passage 15 extending to the fuel injection valve 16 is opened. Additionally, a spring 52 is disposed in such a manner that the diaphragm 46 is so pressed as to move away from the valve seat 51. Thus, the diaphragm 46 constitutes a constant differential pressure valve which moves toward or away from the valve seat 51 in dependence upon the difference between the force pressing the diaphragm toward the second pressure chamber 48 and the difference in pressure between the first and the second pressure chambers 47 and 48 which urges the diaphragm toward the first pressure chamber 47. By the way, the upstream side of the variable slit constituted by the fuel metering rod 8 is directly communicated with the high pressure fuel source 20 and thus subjected to the pressure exerted by the latter.

It is assumed that the pressure within the second pressure chamber 48 is maintained at a predetermined level relative to the pressure of the high pressure source 20 while the pressure difference produced across the variable slit is increased (i.e. the pressure at the downstream side is decreased because the upstream side is constantly at the pressure of the high pressure fuel source 20). Under these conditions, the diaphragm 46 tends to be pressed toward the first pressure chamber 47 thereby to restrict or eventually close the valve passage defined between the diaphragm 46 and the valve seat 51. As a result, the pressure within the first pressure chamber 47 is increased, whereby the pressure difference across the variable slit is reduced. On the other hand, upon decrease of the pressure difference across the variable slit (i.e. upon increase in pressure at the downstream side), the diaphragm 46 is displaced toward the second pressure chamber 48 to enlarge the valve passage, involving decrease in pressure within the first pressure chamber 47. Consequently, so far as the pressure within the second pressure chamber 48 is maintained at a constant level, the pressure in the first pressure chamber will also remain constant and thus the pressure difference produced across the variable slit constituted by the fuel metering rod 8 can be maintained constant.

It will be now appreciated that the fuel is constantly subjected to a constant pressure difference across the variable slit of the fuel metering rod 8 under the control through the fuel pressure differential apparatus 14. This feature in combination with the interlocking between the fuel metering rod 8 and the air valve 3 such that the flow section of the variable slit may be proportional to the opening degree of the air valve 3 will assure that the flow of fuel flowing through the variable slit is in exact proportion to the opening degree of the air valve 3. In this conjunction, since the pressure prevailing at the upstream side of the air valve 3 may be regarded to be equal to the atmospheric pressure in addition to the fact that the pressure at the downstream side of the air valve (i.e. pressure within the air pressure chamber 6) is maintained constant under the control of the air valve 3, the intake air flow passing through the main body 1 is exactly proportional to the opening degree of the air valve 3. In this way, the combination of the air valve and the fuel metering arrangement described above allows the fuel feed quantity to be maintained at a predetermined constant ratio relative to the intake air quantity independently of variation thereof. This means that the air-fuel ratio can be always maintained at a constant value.

Now, assuming that the opening degree of the air valve 3 is represented by Aa and pressures at the upstream and the downstream sides of the air valve 3 are represented by Po and Pa, respectively, the intake or suction air flow Ga can be expressed as follows:

$$Ga \propto Aa\sqrt{Po-Pa} \quad (1)$$

On the other hand, if the area of flow section of the variable slit constituted by the fuel metering rod 8 is represented by Af with the pressures at the upstream and downstream sides thereof being represented by Ph and Pc, respectively, the fuel injection quantity Gf can be given by the following expression:

$$Gf \propto Af\sqrt{Ph-Pc} \quad (2)$$

From the expressions (1) and (2), the air-fuel ratio Ga/Gf is given as follows:

$$Ga/Gf \propto (Aa/Af)\cdot(\sqrt{Po-Pa}/\sqrt{Ph-Pc}) \quad (3)$$

Since the air valve control apparatus and the fuel pressure differential apparatus as described above function to maintain the conditions Po−Pa and Ph−Pc to be constant and in addition the air valve 3 is so interlocked with the fuel metering rod 8 that the ratio Aa/Af may be constant, the air-fuel ratio Ga/Gf is maintained constant.

The present invention contemplates varying the condition Ph-Pc in dependence on the operating conditions of the internal combustion engine and correcting the air-fuel ratio at an optimum value for the operation of the engine. Now, assuming that the pressure difference Ph-Pc is increased by 10%, the ratio of normal air-fuel ratio to the one to be corrected will become equal to $\sqrt{1.1}$, which indicates that the fuel concentration will be increased about 5%. On the contrary, when the pressure difference Ph-Pc is decreased by 10%, the fuel concentration or density will be reduced about 5%. Note that the pressure Ph is equal to the pressure of the high pressure fuel source 20 and maintained at a predetermined constant differential pressure relative to the atmospheric pressure, as described hereinbefore in conjunction with the fuel pressure differential apparatus 14. On the other hand, the pressure Pc is equal to the pressure prevailing within the first pressure chamber 47 of the fuel pressure differential apparatus 14 and maintained at a predetermined pressure difference relative to the pressure prevailing within the second pressure chamber 48. Accordingly, the pressure Pc can be varied by changing the pressure within the second pressure chamber 48. With the present invention, it is intended to automatically increase or decrease the pressure within the second pressure chamber 48 as a function of the operation state of the internal combustion engine thereby to correct the air-fuel ratio so as to be at an optimum level for the operation of the engine by correspondingly varying the pressure difference Ph-Pc produced across the variable slit of the fuel metering rod 8.

Now, an apparatus embodying the teachings of the invention will be described by way of example with reference to FIG. 2. As described hereinbefore, the second pressure chamber 48 is communicated to the high pressure fuel source 20 through the fixed orifice 49. Additionally, the second pressure chamber 48 is communicated with a first correction chamber 53 and a second correction chamber 54 through a conduit or passage 50. In more detail, the first correction chamber 53 is connected to the conduit 50 through a fixed orifice 55 as well as through another fixed orifice 56 and a bimetal valve 57 both disposed in parallel with the orifice 55. Besides, the chamber 53 is also communicated to the low pressure fuel source 25 through a fixed or unvariable orifice 58 as well as through another fixed orifice 59 and a bellows valve 60 both disposed in parallel with the orifice 58. The second correction chamber 54 is connected to the conduit 50 through a fixed orifice 61 on one hand and communicated with the high pressure fuel source 20 through an electromagnetic valve 62 and a fixed orifice 63. Additionally, the second correction chamber 54 is communicated with a variable volume chamber 66 of a sensor for detecting acceleration and deceleration through a fixed orifice 64 and a check valve 65 disposed in parallel with the former. The variable volume chamber 66 in turn is communicated with the high pressure fuel source 20 through a fixed orifice 57. The acceleration/deceleration sensor includes a piston 69 which is interlocked with the throttle valve 4 shown in FIG. 1 through a link represented by a dotted broken line 68. The piston 69 is slidably accommodated within a cylinder 70 and constitutes a part for both of a full sensor valve and an idle sensor valve. The full sensor valve is composed of an inlet port 71 and an outlet port 72 provided at lateral sides of the cylinder 70 in opposition to each other and an annular groove 73 formed in the piston 69. When the throttle valve 4 is nearly at a fully opened position, the grove 73 will come to alignment with both ports 71 and 72 thereby to allow these ports to be communicated with each other. The inlet port 71 is connected to the conduit 50 through a fixed orifice 74, while the outlet 72 is directly communicated to the first correction chamber 53. The idle sensor valve is composed of an inlet port 75 communicated with the high pressure fuel source 20 and an outlet port 76 provided at the opposite side and axially offset rightwards relative to the inlet port 75, as viewed in FIG. 2. When the throttle valve 4 is positioned at the idle opening, the piston 69 opens the outlet port 76 to allow it to be communicated with the high pressure fuel source 20. The outlet port 76 of the idle detector valve is on the other side communicated with a pressure chamber 80 of a deceleration valve 79 disposed in the fuel conduit 15 through a high boost detector valve 77 and a conduit 78. The pressure chamber 80 of the deceleration valve 79 also is communicated with the first correction chamber 53 through a fixed orifice 81. The high boost detector or sensor valve 77 is subjected to a back pressure of a magnitude equal to the pressure prevailing within the interior 112 of the intake conduit 111 downstream of the throttle valve 4 through a passage 82 opened in the intake conduit. The valve 77 is usually urged to the closing position under the action of a spring 83 and is adapted to be opened, when the outlet port 76 of the idle sensor valve is opened and in addition the pressure within the intake conduit 111 downstream of the throttle valve 4 drop below a predetermined level.

Figure 3:
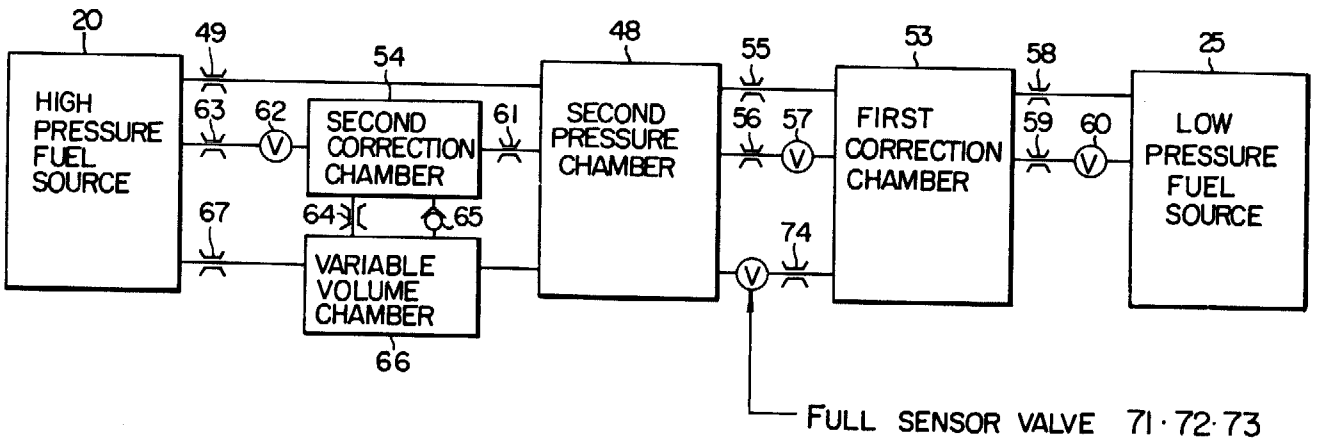
FIG. 3 is a block diagram to illustrate the principle of controlling the air-fuel ratio according to the invention.

The above described arrangement of the fuel circuit extending from the high pressure fuel source 20 to the low pressure fuel source 25 through the second pressure chamber 48 is schematically illustrated in a block diagram of FIG. 3. Since the pressure in the high pressure fuel source 20 and the low pressure fuel source 25 are maintained at constant differences relative to the atmospheric pressure, respectively, by means of the high pressure valve 21 and the low pressure valve 24, the pressure level within the second pressure chamber 48 is determined by resistances and fuel flows established in the individual circuitries provided between the high pressure fuel source 20 and the low pressure fuel source 25. In other words, the pressure within the second pressure chamber 48 can be varied by changing these resistances and flows. For example, when the electromagnetic or solenoid valve 62 shown also in FIG. 3 is opened, the resistance in the circuit connecting the high pressure fuel source 20 and the second pressure chamber 48 to each other is decreased, as a result of which the pressure within the second pressure chamber 48 is raised. The rate of such pressure rise will become higher, as the opening ratio of the electromagnetic valve 62 which will be described in detail hereinafter is increased. Further, when the bimetal valve 57, full sensor valve and/or the bellows valve 60 is opened, the resistance in the circuit extending from the second pressure chamber 48 to the low pressure fuel source 25 is reduced, the resulting in a drop of pressure level in the second pressure chamber 48. The rate of such pressure drop is determined by combinations of the operating states of the above mentioned valves. Besides, while the volume of the variable volume chamber 66 of the acceleration/deceleration sensor is increased, the pressure in the second pressure chamber 48 is correspondingly lowered, since the fuel will flow out from the second correction chamber 54 through the check valve 65. On the other hand, while the volume of the variable volume chamber 66 is decreased, the pressure in the second pressure chamber 48 is correspondingly raised. In this manner, the pressure within the second pressure chamber 48 is varied in response to the operating states of the various valves and the change in volume of the variable volume chamber 66, which in turn are automatically controlled in dependence on the operating conditions of the internal combustion engine, as described hereinafter.

It should be further noted that the first pressure chamber 47 of the fuel pressure differential apparatus 14 is provided with a fixed orifice 84 from which a by-pass conduit extends to the high pressure fuel source 20 through an electromagnetic valve 85, which is usually opened. However, upon elapse of a time interval determined by the temperature of cooling water after the starting of the engine, the valve 85 is closed. During the opening of the valve 85, the fuel from the high pressure fuel source 20 is caused to flow directly into the first pressure chamber 47 and hence to the fuel injection valve 16 through the fuel feed conduit 15. The temperature of cooling water is detected by a thermistor 88 mounted on a coolant circulating pipe 87 (s. FIG. 1). Disposed further in the fuel feed conduit 15 between the deceleration valve 79 and the fuel injection valve 16 is another electromagnetic or solenoid valve 86 which is adapted to open so long as an ignition switch is turned on. The fuel injection valve 16 remains in the closed state under the action of a spring 89 when no fuel is fed thereto. Upon supply of the fuel, the valve 16 is opened under increased fuel pressure against the force of the spring 89, whereby the fuel is injected into the intake conduit 111 through the injection nozzle 17.

In connection with the arrangement just described above, it is preferred to provide an air discharge opening 90 at a right angle to the passage extending between the fuel injection valve 16 and the discharge nozzle 17, thereby to promote atomization of the fuel under the action of air jet. The air discharge port 90 is supplied with air from the upstream side of the air valve 3 through a passage 92 having a fixed orifice 91. The air discharge port 90 is further communicated with the intake conduit 111 upstream of the throttle valve 4 by way of a passage 93, thereby to promote the atomization of the fuel to be injected and at the same time to serve for supplying a part of air metered by the air valve 3 to the engine during the idle operation thereof by by-passing the throttle valve 4. Mounted in the passage 93 is a wax valve 94 which senses the temperature of the cooling water and is adapted to further increase the air flow section of the passage 93 as the sensed temperature is lower. In other words, the quantity of air flowing through the passage 93 is progressively reduced as the temperature of cooling water is raised after the cold starting of the engine. The feature contributes to the improvement of warming-up performance of the engine.

Figure 4A:
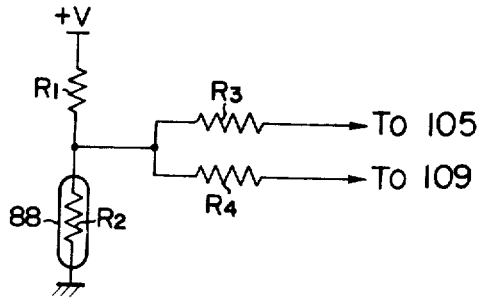
FIGS. 4*a*, 4*b* and 4*c* show electric circuits for controlling electromagnetic valves employed in the fuel supply apparatus shown in FIG. 2.
Figure 4B:
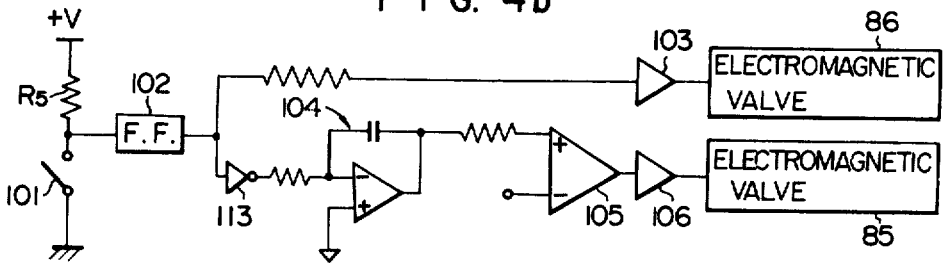
Figure 4C:
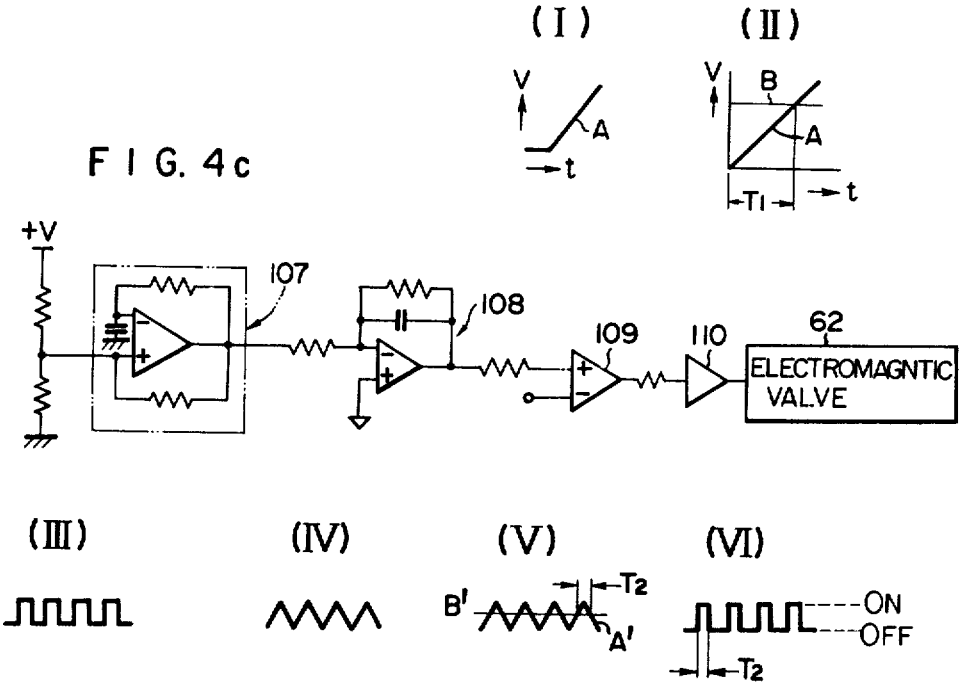

FIGS. 4*a* to 4*c* show electric circuits for controlling the electromagnetic valves 62, 85 and 86 described above. Referring to FIG. 4*a*, the thermistor 88 mounted on the water pipe line 87 (s. FIG. 1) exhibits a negative temperature coefficient, i.e. resistance $R_2$ of the thermistor 88 becomes higher, as the temperature of cooling water is lower. The thermistor 88 has one end grounded and the other end connected to a constant voltage supply source +V through a resistor $R_1$. The voltage appearing across the thermistor or variable resistor $R_2$ which is higher for a lower temperature of cooling water is applied to an inverting input terminal of a comparator 105 shown in FIG. 4*b* through a resistor $R_3$ and at the same time to an inverting input terminal of a comparator 109 shown in FIG. 4*c* through a resistor $R_4$. In FIG. 4*b*, a starter switch 101 turns on or off the grounded path of a terminal to which a resistor $R_5$ and a flip-flop 102 are connected. The other end of the resistor $R_5$ is connected to the constant voltage source +V. The flip-flop 102 is adapted to produce an output signal only when both of the ignition switch and the starter switch have been closed and remains in this state even when the starter switch is opened, so far as the ignition switch is closed. The output from the flip-flop 102 is utilized for energizing the electromagnetic valve 86 after having been amplified through an amplifier 103. Further, the output from the flip-flop 102 is applied also to an integrator 104 after having been inverted in polarity through an inverter 113. The integrator 104 produces an output voltage A which is linearly increased as a function of time as illustrated in a graph (I). The output voltage A is applied to a non-inverting input terminal of the comparator 105 to be compared with the voltage applied to the inverting input terminal thereof through the resistor $R_3$. When the input voltage applied to the non-inverting input terminal is higher than the one applied to the inverting input terminal, the comparator 105 will produce an output voltage, which is supplied to the electromagnetic valve 85 for the driving thereof after having been amplified through an amplifier 106. As can be seen from a voltage-time diagram (II) of FIG. 4*b*, the time interval $T_1$ elapsed from the time when the flip-flop 102 generates its output signal to the time when the comparator 105 produces its output signal is determined by the distance between the axis of the ordinate V and the intersecting point between the curve A representing the output voltage of the integrator 104 and the line B representing the voltage derived through the resistor $R_3$. Thus the time interval $T_1$ becomes longer, as the voltage 3 is higher (or temperature of cooling water as detected by the thermistor 88 is lower). In other words, the time delay intervening between the turn-on of the starter switch 101 and the energization of the electromagnetic valve 85 becomes greater, as the temperature of the engine is lower.

Referring to FIG. 4*c*, an oscillator 107 generates a rectangular pulse signal having a predetermined frequency such as shown in a graph (III). This pulse signal is converted into a saw tooth wave pulse signal shown in a graph (IV) through an integrator 108 and applied to a noninverting input terminal of a comparator 109 which has an inverting input terminal applied with the voltage derived from the thermistor 88 through the resistor $R_4$ to be compared with the saw tooth wave voltage produced from the integrator 108. When the output voltage of the integrator 108 increases beyond the voltage derived through the resistor $R_4$, an output voltage is produced from the comparator 109. This operation is illustrated in a graph (V) of FIG. 4*c*. As can be seen from this graph, the comparator 109 produces a series of pulses having a pulse width $T_2$ corresponding to a time duration determined by the saw tooth wave voltage A' exceeding the thermistor voltage B' derived from the resistor $R_4$ and a frequency equal to that of the output from the oscillator 107. This pulse signal is utilized for energizing the electromagnetic valve 62 after having been amplified through an amplifier 110. The electromagnetic valve 62 is intermittently opened with a frequency equal to that of the oscillator 107 with the opened duration corresponding to the pulse width $T_2$, as illustrated in a graph (VI) of FIG. 4*c*. Thus, the duty ratio of the electromagnetic valve 62 (ratio of the open time duration to a cycle period of opening and closing) becomes smaller, as the engine temperature is lower, because the thermistor voltage B' becomes higher, resulting in a shorter pulse width $T_2$ at a lower temperature of the engine.

The fuel supply apparatus for an internal combustion engine of the construction described above is operated in such a manner as described below. Upon turning on of the ignition switch at the time of starting the internal combustion engine, the fuel pump 19 is operated to bring the pressures of the high pressure fuel source 20 and the low pressure fuel source 25 to the respective predetermined pressure levels. The thermistor 88 detects the temperature of the cooling water, as a result of which signal voltage corresponding to the sensed water temperature is set at the inverting input terminals of the comparators 105 (FIG. 4*b*) and 109 (FIG. 4*c*). When the starter switch 101 is turned on, the flip-flop 102 produces output voltage to open the electromagnetic valve 86. Subsequently, the electromagnetic valve 85 is actuated with the time delay $T_1$. As noted hereinbefore, the valve 85 is of a normally open type. Accordingly, the valve 85 is closed after the time elapse of $T_1$ from the turn-on of the starter switch 101 and remains in the closed state until the ignition switch is turned off. During the opening of the electromagnetic valve 85, the fuel flows from the high pressure fuel source 20 directly into the first pressure chamber 47 of the fuel pressure differential apparatus 14 through the fixed orifice 84. This fuel quantity is fed immediately to the injection valve 16 through the feed conduit 15 upon opening of the electromagnetic valve 86 brought about by the turn-on of the starter switch, thereby to be injected into the intake conduit 111 from the discharging nozzle 17 and supplied to the engine during starting operation. The transient time interval $T_1$ elapsed from the opening of the electromagnetic valve 86 to the closing of the electromagnetic valve 85 is a function of the temperature of cooling water sensed by the thermistor, as described hereinbefore, and becomes longer, as the water temperature is lower. When the engine is started, a part of intake air is supplied to the air discharge opening 90 through the passage 93 by-passing the throttle valve 4 to be mixed with the fuel flowing from the injection valve 16 to the fuel discharge nozzle 17, thereby to promote the atomization of fuel. Such partial air supply has a similar effect as the increasing of intake air quantity through the opening of the throttle valve 4 to increase the rotational speed during idling operation and prevent the stalling of the engine during the warming-up operation immediately after the starting. As the temperature of cooling water is raised, the opening degree of the wax valve 94 is reduced, resulting in a decreased by-passing air quantity flowing through the passage 93. In this manner, the warm-up performance is improved and at the same time purification of the exhaust gas from the engine during the starting operation is significantly enhanced.

During the normal operation of the internal combustion engine, the electromagnetic valve 85 is closed and a quantity of fuel as metered by the fuel metering rod 8 will flow into the first pressure chamber 47 of the fuel pressure differential apparatus 14, whereby fuel flow controlled at such a rate as to provide a predetermined air-fuel ratio for the intake air quantity is fed to the fuel injection valve 16. This flow rate remains unvariable so far as the pressure in the second pressure chamber 48 of the pressure differential apparatus 14 is constant. In this connection, it should be however noted that the pressure within the second pressure chamber 48 is varied in dependence on operating conditions of the internal combustion engine.

So long as the temperature of cooling water is lower, fuel flow into the second correction chamber 54 will be smaller because of a smaller duty ratio of the electromagnetic valve 62, as described hereinbefore by referring to FIG. 4. Under such circumstance, the pressure prevailing within the second pressure chamber 48 becomes lower, whereby the quantity of fuel supplied through the fuel metering rod 8 is more increased. On the contrary, when the temperature of cooling water is higher, the duty ratio of the electromagnetic valve 62 is correspondingly increased, resulting in the pressure within the second pressure chamber 48 is being raised and the quantity of fuel metered by the fuel metering rod 8 is reduced. In this manner, the electromagnetic valve 62 regulates the air-fuel ratio in dependence on the temperature of the engine. Of course, the valve 62 is not restricted to the type described above but many other types of valve such as a variable orifice having flow area variable as a function of the cooling water temperature may be employed.

The bellows valve 60 responds to the pressure of the low pressure fuel source 25 and is opened at a high level of the pressure with the valve opening thereof being enlarged as the pressure level is higher. When the opening of the bellows valve 60 is increased, the fuel flow from the first correction chamber 53 into the low pressure fuel source 25 is correspondingly increased, resulting in a decreased pressure within the second pressure chamber 48, whereby the concentration of the air-fuel mixture is increased. On the other hand, since the low pressure fuel source 25 is maintained at a predetermined pressure difference relative to the atmospheric pressure, the pressure of the former is raised as the latter becomes higher. This in turn results in a much enlarged opening of the bellows valve 60 to enhance the concentration of the air-fuel mixture. In this manner, the bellows valve 60 serves to provide an optimum air-fuel ratio in response to the atmospheric pressure.

The bimetal valve 57 is designed to respond to the temperature of fuel in the first correction chamber 53 and adapted to open at a high fuel temperature and close at a low temperature. Since the fuel in the first correction chamber 53 is circulated from the high pressure fuel source 20 to the low pressure fuel source 25 through the fuel pump 18, the temperature of fuel may be considered as reflecting essentially the temperature of ambient air. Thus, the bimetal valve 57 is opened at a low ambient temperature, involving decrease in the pressure within the second pressure chamber 48 as accompanied by an increased concentration of the air-fuel mixture. On the contrary, when the ambient temperature is high, the bimetal valve 57 is closed to increase the pressure within the second pressure chamber 48, thereby resulting in a reduced concentration of the air-fuel mixture. In this way, deviation from the selected air-fuel ratio due to variation in the specific density of intake air caused by change in the ambient temperature can be corrected or compensated.

The piston 69 of the acceleration/deceleration sensor is interlocked with the throttle valve 4. As the throttle valve 4 is opened, the volume of the variable volume chamber 66 is increased. In the meantime, the fuel flows out from the second correction chamber 54 through the check valve 65 thereby to decrease the pressure in the chamber 54, involving an increased concentration of the air-fuel mixture. In this conjunction, it should be mentioned that the pressure within the second pressure chamber 48 is determined by the ratio between the quantity of fuel supplied through the electromagnetic valve 62 and the quantity of fuel as flowing out through the check valve 65. Accordingly, the pressure within the second pressure chamber 48 is lowered, as the duty ratio of the electromagnetic valve 62 becomes smaller due to a lower temperature of cooling water. The result will be an increased concentration of the air-fuel mixture. While the throttle valve 4 is being closed, the volume of the variable volume chamber 66 will be concurrently decreased. Under such circumstance, fuel will flow into the second correction chamber 54 through the fixed orifice 64, resulting in a lean air-fuel mixture. In brief, the acceleration/deceleration sensor serves to provide a rich air-fuel mixture during the acceleration of vehicle, while providing a lean air-fuel mixture during the deceleration. The degree of variations in the air-fuel ratio during acceleration or deceleration becomes greater when the engine temperature is at a lower level.

When the throttle valve 4 has been opened substantially fully, the annular groove 73 formed in the piston 69 interlocked with the throttle valve 4 is aligned with the ports 71 and 72. The full sensor valve is thus opened. At that time, the second pressure chamber 48 becomes communicated with the first correction chamber 53 through a circuit path extending from the fixed orifice 74 through the now opened full sensor constituted by the port 71, the annular groove 73 and the port 72 in addition to the circuit extending from the fixed orifices 55 and 56 through the bimetal valve 57 to the first correction chamber 53, so that the pressure in the second pressure chamber 48 is decreased to enrich the air-fuel mixture. In this manner, an increased fuel supply to the engine can be accomplished during the operation under higher load.

When the throttle valve 4 reaches the idle position, the piston 69 functions as the idling detector valve to open the port 76, whereby the fuel is permitted to flow from the high pressure fuel source 20 through the ports 75 and 76 to the high boost detector valve 77. When the pressure prevailing in the intake conduit 111 at that time is very low, the back pressure applied to the high boost detector or sensor valve 77 through the passage 82 becomes low, resulting in that the high boost detector valve 77 is opened and the pressure chamber 80 of the deceleration valve 79 is subjected to the pressure of the high pressure fuel source 20 thereby to be closed. In other words, under the conditions that the throttle valve 4 has reached the idle position and that the pressure within the intake conduit 111 becomes substantially low as compared with the intake air pressure during idling operation, the deceleration valve 79 is closed to interrupt the fuel supply to the fuel injection valve 16.

Upon turning-off of the ignition switch, the electromagnetic valves 62 and 86 are closed, the electromagnetic valve 85 is opened and the fuel pump 19 is stopped.

As will be appreciated from the foregoing description, it is possible according to the invention to accomplish a fine control of the air-fuel ratio with a relatively simplified structure by virtue of such arrangement that all various factors relating to the operating conditions of an internal combustion engine such as temperature of ambient air, atmospheric pressure, and the temperature, acceleration, deceleration, output power and the like of the internal combustion engine can be reflected as variations in pressure within the second pressure chamber 48 of the fuel pressure differential apparatus 14. The present invention thus contributes to the purification of exhaust gas and at the same time to the fuel economization with unnecessary fuel supply being suppressed. Additionally, the duty ratio of the electromagnetic valve 62 is varied as a function of the temperature of cooling water after the cold starting of the engine thereby to vary continuously the air-fuel ratio until the engine has been warmed-up. This feature in combination with the operation of the wax valve 94 to vary continuously the intake air quantity during idling operation as a function of the temperature of cooling water until the engine has been warmed up will improve remarkably the warming-up performance of the engine. The fuel supply apparatus according to the invention can be realized on a mass production base at a low cost substantially equivalent to that of the apparatus of the carburetor type.

What is claimed is:

1. An air-fuel ratio control system for an internal combustion engine comprising an intake conduit, a throttle valve disposed in said intake conduit, a fuel discharge port opened to said intake conduit and a fuel feed conduit for supplying fuel to said discharge port; said control system comprising an air valve disposed in said intake conduit upstream of said throttle valve thereby to define an air pressure chamber between said throttle valve and said air valve in said intake conduit; control means for controlling the opening area of said air valve in response to variation in pressure in the air pressure chamber defined between said throttle valve and said air valve so as to maintain the pressure in the air pressure chamber substantially constant; a variable throttle means disposed in said fuel feed conduit for controlling the quantity of fuel to be supplied through said feed conduit to said discharge port; means for interlocking said variable throttle means with said air valve in such a way that the flow sectional area of said variable throttle means is always maintained substantially in proportion to the opening area of said air valve; a fuel pressure differential device composed of a first pressure chamber subjected to a pressure equivalent to the pressure in said fuel feed conduit downstream of said variable throttle means, a second pressure chamber, means for maintaining said second pressure chamber at a pressure different from the pressure in said first pressure chamber and a constant differential pressure valve disposed in said fuel feed conduit downstream of said variable throttle means and responsive to variation in the pressure difference between said first and second pressure chambers for controlling the pressure in said feed conduit downstream of said variable throttle means at a pressure having a predetermined difference from the pressure in said second pressure chamber; a first fluid source maintained at a high pressure; a second fluid source maintained at a low pressure; a fluid circuit arranged in such a way that fluid flows from said first fluid source to said second fluid source via said second pressure chamber; and at least two flow control means disposed in said fluid circuit, each being responsive to variation of one of parameters representing environmental and/or operating conditions of said internal combustion engine for controlling fluid flow in said fluid circuit thereby to correct the pressure in said second pressure chamber.

2. An air-fuel ratio control system as set forth in claim 1, wherein said constant differential pressure valve comprises a diaphragm disposed as a partition between said first and second pressure chambers and adapted to respond to variation in pressure difference between said first and second pressure chambers, and a valve seat disposed in said first pressure chamber around a valve orifice opened thereto, said diaphragm being adapted to move toward and away from said valve seat in response to said pressure difference.

3. An air-fuel ratio control system as set forth in claim 2, wherein said first and second fluid sources consist of high and low pressure fuel sources, respectively, each of which is maintained at a predetermined pressure difference relative to the atmospheric pressure, said fuel feed conduit is supplied with fuel from said high pressure fuel source, and wherein said second pressure chamber is communicated with said high pressure fuel source through at least one fixed orifice and at last one of said flow control means disposed in parallel with said fixed orifice and with said low pressure fuel source through at least one fixed orifice and at least one of said flow control means disposed in parallel with said second-mentioned fixed orifice.

4. An air-fuel ratio control system as set forth in claim 3, wherein said flow control means comprises a temperature responsive valve means disposed in a path for communicating said second pressure chamber with said low pressure fuel source and adapted to decrease or increase the opening degree thereof in response to increase or decrease in ambient temperature.

5. An air-fuel ratio control system as set forth in claim 4, wherein said temperature responsive valve means consists of a bimetal valve adapted to respond to temperature of fuel to be controlled by said bimetal valve.

6. An air-fuel ratio control system as set forth in claim 3, wherein said flow control means comprises a pressure responsive valve disposed in a path for communicating said second pressure chamber with said low pressure fuel source and adapted to increase or decrease the opening degree thereof in response to increase or decrease in the atmospheric pressure.

7. An air-fuel ratio control system as set forth in claim 6, wherein said pressure responsive valve consists of a bellows valve adapted to respond to pressure of fuel to be controlled by said bellows valve.

8. An air-fuel ratio control system as set forth in claim 3, wherein said flow control means comprises a flow control valve disposed in a path for communicating said second pressure chamber with said high pressure fuel source and adapted to increase or decrease the opening degree thereof in response to increase or decrease in temperature of said internal combustion engine.

9. An air-fuel ratio control system as set forth in claim 8, wherein said flow control valve consists of an electromagnetic valve adapted to be intermittently opened with a duty ratio varying in dependence on temperature of water for cooling said internal combustion engine.

10. An air-fuel ratio control system as set forth in claim 3, wherein said flow control means comprises a variable volume chamber means communicated with a path for communicating said second pressure chamber with said high pressure fuel source and adapted to increase or decrease the volume thereof in response to opening or closing operation of said throttle valve.

11. An air-fuel ratio control system as set forth in claim 3, wherein said flow control means comprises a cut off valve disposed in a path for communicating said second pressure chamber with said low pressure fuel source and interlocked with said throttle valve so as to be opened only when said throttle valve is fully opened.

12. An air-fuel ratio control system as set forth in claim 3, including a first circuit path provided with a fixed throttle and serving to communicate said high pressure fuel source with said second pressure chamber, an electromagnetic valve communicated with said high pressure fuel source through a fixed throttle and adapted to be intermittently opened with a duty ratio increased or decreased in dependence on increase or decrease in temperature of cooling water for said internal combustion engine, a second correction chamber communicated directly with said electromagnetic valve and with said second pressure chamber through a fixed throttle, a variable volume chamber communicated with said high pressure fuel source through a fixed throttle and with said second correction chamber through a fixed throttle and a check valve disposed in parallel with said last mentioned fixed throttle so as to prevent fuel flow toward said second correction chamber and adapted to increase or decrease in its volume in response to opening or closing operation of said throttle valve, a first correction chamber communicated with said second pressure chamber through a second circuit path having a fixed throttle and further communicated with said low pressure fuel source through a third circuit path having a fixed throttle, a bimetal valve disposed in parallel with said second circuit path in communication with said first correction chamber and with said second pressure chamber through a fixed throttle and adapted to decrease or increase the opening degree thereof in dependence on increase or decrease in temperature of fuel, a cut off valve disposed in parallel with said second circuit path and said bimetal valve in communication with said second pressure chamber and with said first correction chamber through a fixed throttle and adapted to be opened only when said throttle valve is opened fully, and a bellows valve disposed in parallel with said third circuit path in communication with said low pressure fuel source and with said first correction chamber through a fixed throttle and adapted to increase or decrease the opening degree thereof in response to increase or decrease in fuel pressure.

13. An air-fuel ratio control system as set forth in claim 12, further including a fourth circuit path for communicating said high pressure fuel source with said first pressure chamber, and an electromagnetic valve disposed in said fourth circuit path and adapted to respond to starting of said internal combustion engine and to be closed after a time elapse inversely proportional to the temperature raise in said engine from the starting thereof.

14. An air-fuel ratio control system as set forth in claim 3, wherein said air valve control means comprises a pilot valve having a spool adapted to be displaced in response to variation in pressure in said air pressure chamber defined between said air valve and said throttle valve in said intake conduit, and a hydraulic cylinder accommodating therein a hydraulically actuated piston connected operationally to said air valve and communicated with said high pressure fuel source and said low pressure fuel source through said pilot valve to be hydraulically controlled in dependence on displacement of said spool.

* * * * *